US009403588B1

(12) United States Patent
George et al.

(10) Patent No.: US 9,403,588 B1
(45) Date of Patent: Aug. 2, 2016

(54) OPEN LOOP COOLING SYSTEMS AND METHODS FOR MARINE ENGINES

(71) Applicant: Brunswick Corporation, Lake Forest, IL (US)

(72) Inventors: Trevor George, Eldorado, WI (US); Nathan C. King, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 14/309,131

(22) Filed: Jun. 19, 2014

(51) Int. Cl.
*B63H 20/28* (2006.01)
*B63H 20/32* (2006.01)
*B63H 20/24* (2006.01)

(52) U.S. Cl.
CPC ..... *B63H 20/285* (2013.01); *B63H 20/24* (2013.01); *B63H 20/32* (2013.01); *B63H 2020/323* (2013.01)

(58) Field of Classification Search
CPC ..... F01P 3/202; B63B 2770/00
USPC ..... 440/88–89
See application file for complete search history.

(56) References Cited

U.S. PATENT DOCUMENTS 7,094,118 B1 * 8/2006 Phillips ..... B63H 20/02 440/111
7,114,469 B1 * 10/2006 Taylor ..... B63H 21/00 123/195 P
7,370,611 B1 * 5/2008 White ..... F01P 3/12 123/196 AB
7,398,745 B1 * 7/2008 White ..... F01P 5/14 123/41.01
7,476,135 B2 * 1/2009 Caldwell ..... F01P 3/207 440/88 HE
7,503,819 B1 * 3/2009 Jaeger ..... B63H 21/14 123/41.44
7,585,196 B1 * 9/2009 Jaeger ..... F01P 3/207 440/88 C
7,867,048 B2 * 1/2011 Ochiai ..... F01N 13/004 440/89 F
8,002,597 B2 * 8/2011 Ochiai ..... B63H 20/245 440/77
8,011,985 B2 9/2011 Ochiai
8,113,893 B2 * 2/2012 Konakawa ..... F01N 3/02 440/89 H
8,118,630 B2 * 2/2012 Konakawa ..... F01N 3/10 440/89 G
8,118,631 B2 2/2012 Ochiai
8,142,247 B2 * 3/2012 Konakawa ..... F01N 3/10 440/89 H
8,216,010 B2 * 7/2012 Ochiai ..... B63H 20/24 440/89 H
8,298,025 B2 * 10/2012 Eichinger ..... B63H 21/383 440/3
8,298,026 B2 * 10/2012 Ochiai ..... F01N 3/2842 440/89 C
8,366,501 B2 * 2/2013 Kazuta ..... B63H 21/32 440/89 H
8,402,930 B1 * 3/2013 Taylor ..... F01P 3/202 123/41.17
8,444,447 B2 5/2013 Ochiai
8,469,754 B1 * 6/2013 Maekawa ..... B63H 20/24 440/89 H
8,479,691 B1 * 7/2013 Taylor ..... F01P 3/202 123/41.29
8,500,501 B1 * 8/2013 Taylor ..... B63H 20/24 440/88 K
8,540,536 B1 * 9/2013 Eichinger ..... F01N 3/04 440/88 C
2001/0027757 A1 * 10/2001 Katayama ..... F01P 3/202 123/41.29

(Continued)

*Primary Examiner* — Lars A Olson
*Assistant Examiner* — Jovon Hayes
(74) *Attorney, Agent, or Firm* — Andrus Intellectual Property Law, LLP

(57) ABSTRACT

Systems are for cooling a marine engine that is operated in a body of water. The systems can include an open loop cooling circuit for cooling the marine engine, wherein the open loop cooling circuit is configured to convey cooling water from the body of water to the marine engine so that heat is exchanged between the cooling water and the marine engine, and a pump that is configured to pump the cooling water from upstream to downstream through the open loop cooling circuit. A heat exchanger is configured to cause an exchange of heat between the cooling water located upstream of the marine engine and the cooling water located downstream of the marine engine to thereby warm the cooling water located upstream of the marine engine, prior to cooling the marine engine.

22 Claims, 3 Drawing Sheets

(56) References Cited

U.S. PATENT DOCUMENTS

2002/0166518 A1* 11/2002 Osakabe ..... F01P 3/202
123/41.28
2013/0065462 A1* 3/2013 Saruwatari ..... B63H 21/32
440/88 D
2013/0130577 A1* 5/2013 Ochiai ..... F01N 3/28
440/89 R
2013/0157333 A1* 6/2013 Tetarenko ..... C12P 7/14
435/162
2013/0157532 A1* 6/2013 Takano ..... B63H 20/001
440/88 C
2013/0157533 A1 6/2013 Kato et al.
2013/0203308 A1* 8/2013 Kato ..... B63H 20/24
440/89 C
2013/0203309 A1* 8/2013 Suzuki ..... B63H 20/24
44/89 C

* cited by examiner

OPEN LOOP COOLING SYSTEMS AND METHODS FOR MARINE ENGINES

FIELD

The present disclosure relates to marine engines, open loop cooling circuits for marine engines, and methods of cooling marine engines, including outboard motors.

BACKGROUND

The following U.S. Patents are incorporated herein by reference.

U.S. Pat. No. 7,370,611 discloses a cooling system for a marine propulsion device that provide a bypass loop around a cooling pump that allows the flow of cooling water through certain components to be reduced or increased as a function of the temperature of those components while causing a full flow of cooling water to flow through other selected heat emitting devices. Using this configuration of components and bypass conduits, the operating condition of the cooling water pump can be continually monitored, including the condition of its flexible vanes. By observing the effective cooling capacity of the system under conditions with the bypass valve open and closed, the effectiveness of the cooling water pump can be assessed and a suggestion of maintenance can be provided.

U.S. Pat. No. 7,476,135 discloses a cooling system for a marine vessel that is configured to allow all cooling water to flow out of the cooling circuit naturally and under the influence of gravity when the marine vessel is removed from the body of water. All conduits of the cooling circuit are sloped downwardly and rearwardly from within the marine vessel to an opening through its transom. Traps are avoided so that residual water is not retained within locations of the cooling system after the natural draining process is complete. The opening through the transom of the marine vessel is at or below all conduits of the cooling system in order to facilitate the natural draining of the cooling system under the influence of gravity and without the need for operator intervention.

U.S. Pat. No. 7,503,819 discloses a cooling system for a marine propulsion device that provides a closed portion of the cooling system, which recirculates coolant through the engine block and cylinder head, the exhaust manifold, and the exhaust elbow. It provides a pressure relief cap connected to the exhaust elbow and a low velocity portion of the coolant jacket of the exhaust elbow to facilitate the release of gas and coolant when pressures exceed a preselected magnitude.

U.S. Pat. No. 7,585,196 discloses a cooling system for a marine propulsion device that provides a transom opening that is sufficiently low with respect to other components of the marine propulsion device to allow automatic draining of all cooling water from the system when the marine vessel is removed from the body of water in which it had been operating. The engine cooling passages and other conduits and passages of the cooling system are all located at positions above the transom opening. The system provides automatic draining for a marine cooling system that is an open system and which contains no closed cooling portions.

U.S. Pat. No. 8,298,025 discloses cooling systems and methods for hybrid marine propulsion systems. A first cooling circuit is arranged to convey raw cooling water through an internal combustion engine and to at least one drive component of a drive unit for the marine propulsion system. A second control circuit is arranged to convey raw cooling water through an electric motor. The system is arranged such that raw cooling water in the second cooling circuit is conveyed to the first cooling circuit to cool the drive component without cooling the component of the internal combustion engine.

U.S. Pat. No. 8,402,930 discloses a cooling system for a marine engine that is provided with various cooling channels and passages which allow the rates of flow of its internal streams of water to be preselected so that heat can be advantageously removed at varying rates for different portions of the engine. In addition, the direction of flow of cooling water through the various passages assists in the removal of heat from different portions of the engine at different rates so that overheating can be avoided in certain areas, such as the exhaust manifold and cylinder head, while overcooling is avoided in other areas, such as the engine block.

U.S. Pat. No. 8,479,691 discloses a cooling system for a marine engine provided with various cooling channels which allow the advantageous removal of heat at different rates from different portions of the engine. A split flow of water is conducted through the cylinder head, in opposite directions, to individually cool the exhaust port and intake ports at different rates. This increases the velocity of coolant flow in the downward direction through the cylinder head to avoid the accumulation of air bubbles and the formation of air pockets that could otherwise cause hot spots within the cylinder head. A parallel coolant path is provided so that a certain quantity of water can bypass the engine block and avoid overcooling the cylinder walls.

U.S. Pat. No. 8,500,501 discloses an outboard marine drive that includes a cooling system drawing cooling water from a body of water in which the outboard marine drive is operating, and supplying the cooling water through cooling passages in an exhaust tube in the driveshaft housing, a catalyst housing, and an exhaust manifold, and thereafter through cooling passages in the cylinder head and the cylinder block of the engine. A 3-pass exhaust manifold is provided. A method is provided for preventing condensate formation in a cylinder head, catalyst housing, and exhaust manifold of an internal combustion engine of a powerhead in an outboard marine drive.

U.S. Pat. No. 8,540,536 discloses a cooling system for a marine engine having an elongated exhaust conduit comprising a first end receiving hot exhaust gas from the marine engine and a second end discharging the exhaust gas; and an elongated cooling water jacket extending adjacent to the exhaust conduit. The cooling water jacket receives raw cooling water at a location proximate to the second end of the exhaust conduit, conveys raw cooling water adjacent to the exhaust conduit to thereby cool the exhaust conduit and warm the raw cooling water, and thereafter discharges the warmed cooling water to cool the internal combustion engine.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, systems are for cooling a marine engine that is operating in a body of water. The systems include an open loop cooling circuit for cooling the marine engine, wherein the open loop cooling circuit is configured to convey cooling water from the body of water to the marine engine so that heat is exchanged between the cooling water and the marine engine. A pump is configured to pump the cooling water from upstream to downstream through the open loop cooling circuit. The open loop cooling circuit comprises an upstream inlet that is configured to receive the cooling water from the body of water and a downstream outlet that is configured to discharge the cooling water back to the body of water after the heat has been exchanged between the cooling water and the marine engine. A heat exchanger is configured to cause an exchange of heat between the cooling water located upstream of the marine engine and the cooling water located downstream of the marine engine to thereby warm the cooling water located upstream of the marine engine prior to cooling the marine engine. Methods are for cooling the marine engine.

BRIEF DESCRIPTION OF THE DRAWINGS

Examples of marine engines, open loop cooling circuits for marine engines, and methods of cooling marine engines, including outboard motors, are described with reference to the following figures. The same numbers are used throughout the figures to reference like features and like components.

DETAILED DESCRIPTION OF THE DRAWINGS

Figure 1:
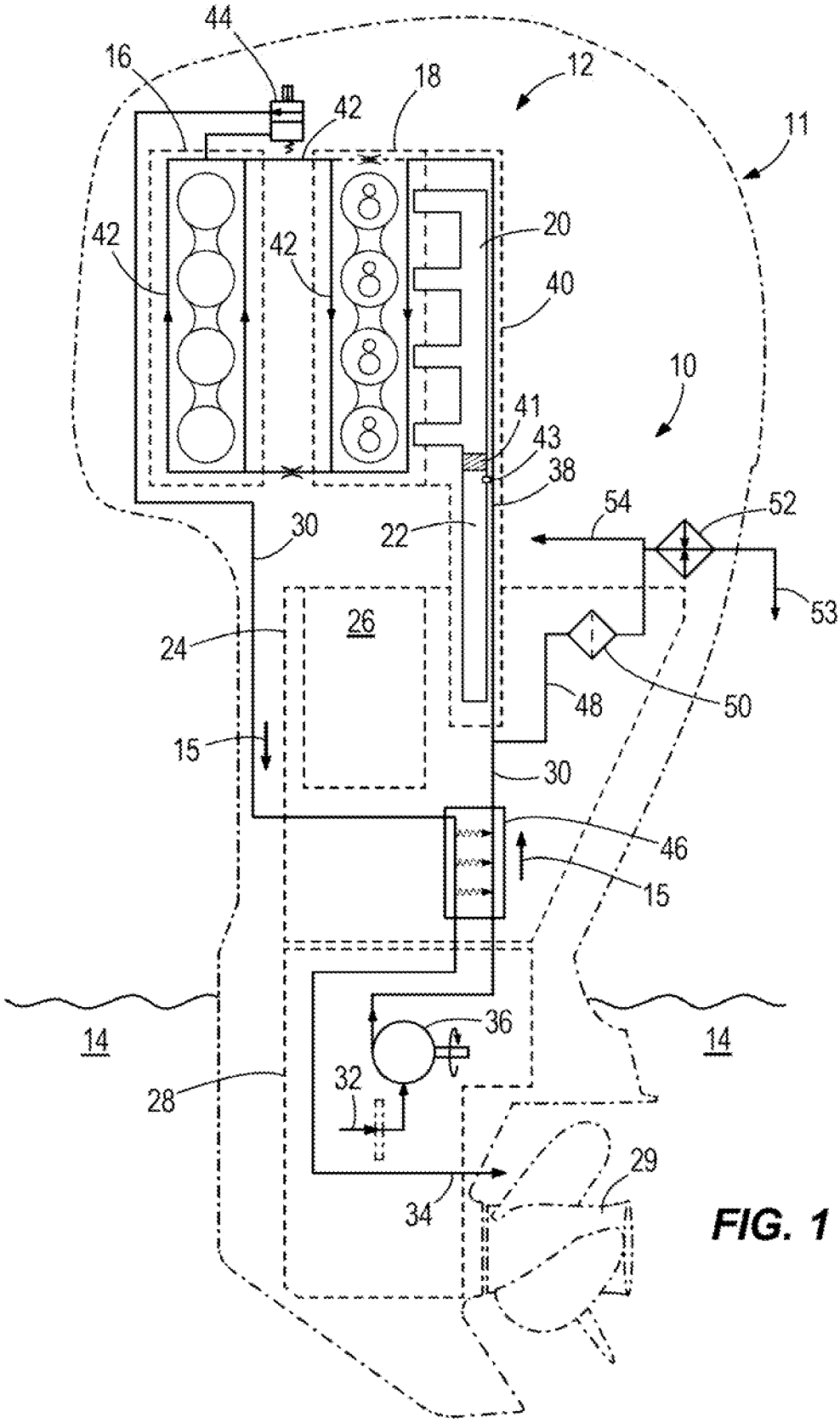
FIG. 1 is a schematic of an open loop cooling system for a marine engine in an outboard motor.

FIG. 1 depicts one example of a system 10 for cooling a marine engine 12 that is operated in a body of water 14. In this example, the marine engine 12 is part of an outboard motor 11; however the concepts of the present disclosure are not limited for use with outboard motors and can also be utilized with other propulsion devices for marine vessels, such as inboard motors, stem drives and/or the like. The marine engine 12 is an internal combustion engine having a cylinder block 16 and a cylinder head 18. An exhaust manifold 20 conveys exhaust gases from the marine engine 12 to an exhaust tube 22 that extends into a midsection or drive shaft housing 24 of the outboard motor 11. An oil sump 26 is located below the marine engine 12 and is configured to contain oil for lubrication of the marine engine 12. The outboard motor 11 further includes a gear case housing 28 that depends from the drive shaft housing 24 and contains transmission gears (not shown) and a propeller shaft (not shown) for driving one or more propellers 29 into rotation based upon operation of the marine engine 12.

The system 10 includes an open loop cooling circuit 30 that has one or more conduits and/or passages and/or cooling jackets that are connected together and configured to convey cooling water from the body of water 14 to the marine engine 12 so that heat is exchanged between the cooling water and the marine engine 12 and various components of the marine engine 12 and outboard motor 11 and then back to the body of water 14. The open loop cooling circuit 30 includes and upstream inlet 32 that is configured to receive the cooling water from the body of water 14 and a downstream outlet 34 that is configured to discharge the cooling water back to the body of water 14 after the heat has been exchanged between the cooling water and the marine engine 12. A pump 36 is configured to pump the cooling water from upstream to downstream, as shown at arrows 15, through the open loop cooling circuit 30.

In this example, the upstream inlet 32 and downstream outlet 34 both are located in the gear case housing 28; however the locations of the upstream inlet 32 and downstream outlet 34 can vary from that shown. The open loop cooling circuit 30 includes an exhaust tube cooling jacket 38 disposed on the exhaust tube 22. The exhaust tube cooling jacket 38 is configured to convey the cooling water towards the marine engine 12 and adjacent to an outside surface of the exhaust tube 22 so that heat is exchanged between the cooling water contained in the exhaust tube cooling jacket 38 and the exhaust gases flowing through the exhaust tube 22, thereby cooling the exhaust gases. The open loop cooling circuit 30 further includes an exhaust manifold cooling jacket 40 disposed on the exhaust manifold 20. The exhaust manifold cooling jacket 40 is configured to convey the cooling water adjacent to an outside surface of the exhaust manifold 20 so that heat is exchanged between the cooling water in the exhaust manifold cooling jacket 40 and the exhaust gases flowing through the exhaust manifold 20, thereby cooling the exhaust gases. Cooling systems incorporating these and other features are disclosed in U.S. Pat. Nos. 8,402,930; 8,479,691; and 8,540,536, which are incorporated herein by reference.

The open loop cooling circuit 30 further includes cooling passages 42 in the cylinder block 16 and cylinder head 18. Examples of such cooling passages are provided in the incorporated U.S. Pat. Nos. 8,402,930 and 8,540,536. The cooling passages 42 are configured to carry cooling water through the cylinder block 16 and cylinder head 18 so that heat is exchanged between the cooling water in the cooling passages 42 and the cylinder block 16 and cylinder head 18, to thereby cool the cylinder block 16 and cylinder head 18. Once the cooling water is discharged from the cooling passages 42, it flows through a thermostat 44, which is configured to open and close based upon the temperature of the cooling water. The thermostat opens to allow flow of cooling water out of the cooling passages 42 and to the downstream outlet 34, as shown at arrows 15.

Through research and experimentation, the present inventors have determined that the cooling of the exhaust gases flowing through the exhaust manifold 20 and exhaust tube 22, via the exhaust tube cooling jacket 38 and the exhaust manifold cooling jacket 40, can cause condensation of water from the exhaust gases, which can accumulate in the exhaust manifold and/or exhaust tube 22. Such accumulation of condensation has been found to adversely affect operation of the marine engine 12 and/or operation of one or more catalysts 41 disposed in the exhaust system for the marine engine 12 and/or operation of sensors 43 in the exhaust system, for example oxygen sensors associated with the one or more catalysts. The catalysts and associated sensors can be located in the exhaust manifold 20 or exhaust tube 22 or other conduits associated therewith. The inventors have recognized this problem and have therefore found it to be desirable to provide a system and method for controlling the temperature of the incoming cooling water conveyed through the noted exhaust tube cooling jacket 38 and exhaust manifold cooling jacket 40, to thereby prevent such condensation and improve performance of the marine engine 12 and any catalyst and/or sensor associated therewith.

According to the present disclosure, the relatively hot cooling water exiting the marine engine 12 passes through a water-to-water heat exchanger 46 and thereby passes energy to the relatively cold cooling water that is pulled from the body of water 14 by the pump 36. This transfer of energy allows the upstream cooling water to be pre-heated, for example prior to entering the exhaust tube cooling jacket 38, exhaust manifold cooling jacket 40 and passages 42 in the marine engine 12. The present inventors have recognized that water temperature will increase most under cold environmental or boundary conditions and at idle engine speed conditions and least under hot environmental or boundary conditions and high engine speed and load conditions. The low speed and temperature conditions provide lower flow rates, which increase water dwell time in the heat exchanger 46, leading to a larger temperature gradient even with less heat exchange. The cold water temperatures provide a large temperature gradient between the upstream cooling water and the downstream (thermostat discharge) water leading to increased heat exchange, as well.

As shown in the example of FIG. 1, the system 10 includes a heat exchanger 46 that is configured to cause an exchange of heat between cooling water located upstream of the marine engine 12 and flowing towards the marine engine 12 and cooling water located downstream of the marine engine 12 and flowing away from the marine engine 12, to thereby warm the cooling water located upstream of the marine engine 12 prior to its cooling of the marine engine 12. This has been found by the inventors to reduce condensation of the exhaust gases.

Figure 2:
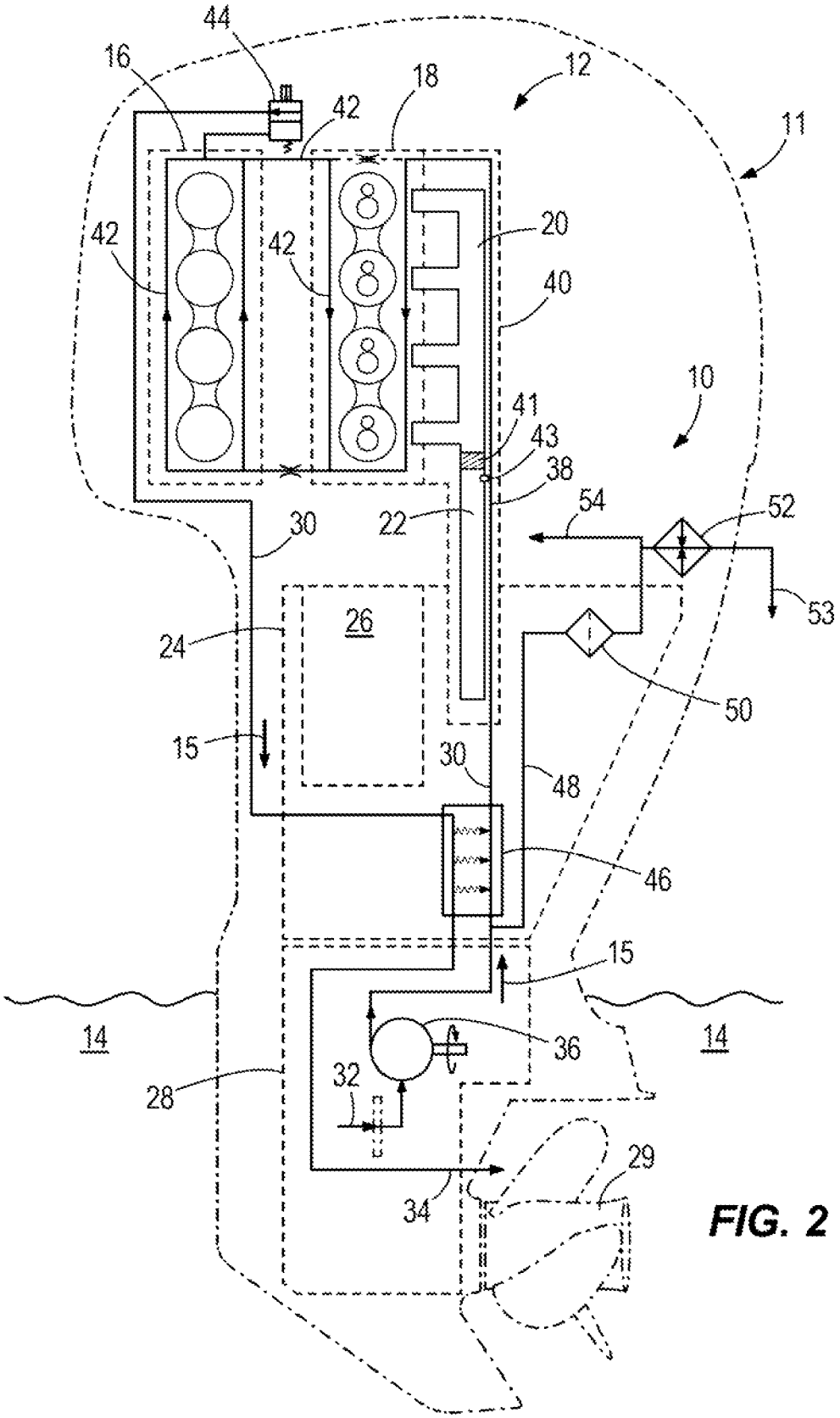
FIG. 2 is a schematic of another embodiment of an open loop cooling system for a marine engine.
Figure 3:
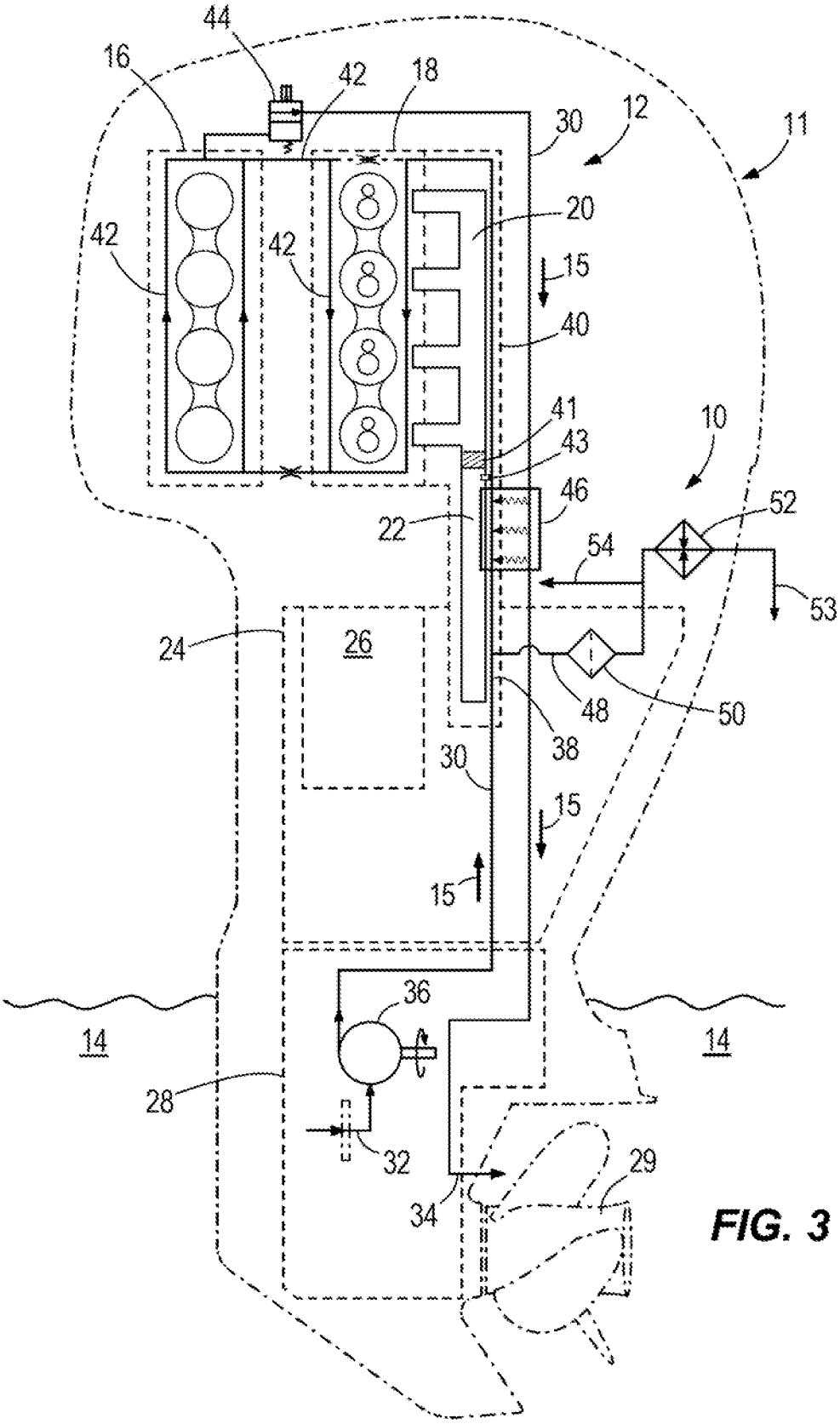
FIG. 3 is a schematic of another embodiment of an open loop cooling system for a marine engine.

The location of the heat exchanger 46 can vary. In the examples shown in FIGS. 1 and 2, the heat exchanger 46 is located in the midsection or drive shaft housing 24. In another example the heat exchanger 46 is located in the gear case housing 28. In another example, shown in FIG. 3, the heat exchanger 46 is located adjacent the exhaust tube cooling jacket 38. In the example of FIG. 3, the heat exchanger 46 has shared walls with the exhaust tube cooling jacket 38. The type of heat exchanger 46 also can vary. In one example, the heat exchanger 46 is a tube-in-tube heat exchanger. In another other example, the heat exchanger 46 is a tube-in-shell heat exchanger. In another example, the heat exchanger 46 is a flat plate counter-flow heat exchanger with or without fins. Other conventional types of heat exchanger 46 can be utilized within the scope of this disclosure.

The open loop cooling circuit 30 further includes a bypass passage 48 that conveys cooling water from the open loop cooling circuit 30 through a strainer 50, past a fuel module 52 and out of a tell-tale 53 on the outboard motor 11. The bypass passage 48 runs past the fuel module so that an exchange of heat is caused between cooling water in the bypass passage 48 and the fuel module 52. Another bypass passage 54 carries cooling water from the bypass passage 48 to an exhaust sprayer for spraying cooling water into the exhaust gases carried through the exhaust tube 22, thereby cooling the exhaust gases. Examples of such an exhaust sprayer are disclosed in the incorporated U.S. Pat. No. 8,540,536.

In the example of FIG. 1, the bypass passage 48 receives cooling water from the open loop cooling circuit 30 at a location that is downstream of the heat exchanger 46. In contrast, in the example of FIG. 2, the bypass passage 48 receives cooling water from the open loop cooling circuit 30 at a location that is upstream of the heat exchanger 46. Through experimentation the inventors have found that providing warm water to the bypass passage 48 adjacent the fuel module 52 can adversely affect the fuel module 52. The example shown in FIG. 2 eliminates this problem by connecting the bypass passage 54 to the bypass passage 48 at a location that is upstream of the heat exchanger 46. The example in FIG. 3 also eliminates this problem by locating the heat exchanger 46 on the exhaust tube 22 adjacent the exhaust tube cooling jacket 38, as discussed above. The example in FIG. 3 is also a more efficient use of space in the gear case housing 28.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims. Each limitation in the appended claims is intended to invoke interpretation under 35 U.S.C. §112(f), only if the terms "means for" or "step for" are explicitly recited in the respective limitation.

What is claimed is:

1. A system for cooling a marine engine that is operated in a body of water, the system comprising:

an open loop cooling circuit for cooling the marine engine, wherein the open loop cooling circuit is configured to convey cooling water from the body of water to the marine engine so that heat is exchanged between the cooling water and the marine engine;

a pump that is configured to pump the cooling water from upstream to downstream through the open loop cooling circuit;

wherein the open loop cooling circuit comprises an upstream inlet that is configured to receive the cooling water from the body of water and a downstream outlet that is configured to discharge the cooling water back to the body of water after the heat has been exchanged between the cooling water and the marine engine; and a heat exchanger that is configured to cause an exchange of heat between the cooling water located upstream of the marine engine and the cooling water located downstream of the marine engine to thereby warm the cooling water located upstream of the marine engine prior to cooling the marine engine.

2. The system according to claim 1, further comprising a driveshaft housing, wherein the heat exchanger is located in the driveshaft housing.

3. The system according to claim 1, further comprising a gear case housing, wherein the heat exchanger is located in the gear case housing.

4. The system according to claim 3, wherein the upstream inlet is located in the gear case housing.

5. The system according to claim 1, further comprising an exhaust tube that is configured to convey exhaust gases from the marine engine, wherein the heat exchanger is located on the exhaust tube.

6. The system according to claim 5, further comprising an exhaust tube cooling jacket on the exhaust tube, wherein the exhaust tube cooling jacket is configured to convey the cooling water from the inlet towards the marine engine.

7. The system according to claim 6, wherein the exhaust tube cooling jacket forms part of the heat exchanger.

8. The system according to claim 1, further comprising an exhaust manifold that is configured to convey exhaust gases from the marine engine, and further comprising an exhaust manifold cooling jacket on the exhaust manifold, wherein the exhaust manifold cooling jacket is configured to convey cooling water past the exhaust manifold to thereby cool the exhaust gases conveyed by the exhaust manifold, and wherein the heat exchanger is configured to warm the cooling water located upstream of the exhaust manifold cooling jacket to thereby prevent condensation from the exhaust gases in the exhaust manifold.

9. The system according to claim 7, further comprising an exhaust tube configured to convey exhaust gases from the exhaust manifold towards the outlet, and further comprising an exhaust tube cooling jacket on the exhaust tube, wherein the exhaust tube cooling jacket is configured to convey cooling water from the marine engine towards the outlet, and wherein the heat exchanger is configured to warm the cooling water located upstream of the exhaust tube cooling jacket to thereby prevent condensation from the exhaust gases conveyed by the exhaust tube.

10. The system according to claim 1, wherein the heat exchanger comprises a tube-in-tube heat exchanger.

11. The system according to claim 1, wherein the heat exchanger comprises a tube-in-shell heat exchanger.

12. The system according to claim 1, comprising a bypass passage connected to the open loop cooling circuit and conveying cooling water past a fuel module, thereby cooling the fuel module.

13. The system according to claim 12, wherein the bypass passage is connected to the open loop cooling circuit at a location that is upstream of the heat exchanger.

14. The system according to claim 12, wherein the bypass passage is connected to the open loop cooling circuit at a location that is downstream of the heat exchanger.

15. The system according to claim 1, comprising a catalyst that is configured to treat exhaust gases that are conveyed from the marine engine.

16. The system according to claim 15, comprising a sensor configured to sense a characteristic of the exhaust gases.

17. A method of cooling a marine engine that is operated in a body of water, the method comprising:

conveying cooling water from the body of water to the marine engine so that heat is exchanged between the cooling water and the marine engine; and causing an exchange of heat between cooling water located upstream of the marine engine and cooling water located downstream of the marine engine to thereby warm the cooling water located upstream of the marine engine prior to cooling of the marine engine.

18. The method according to claim 17, further comprising causing the exchange of heat to occur in a driveshaft housing of the marine engine.

19. The method according to claim 17, further comprising causing the exchange of heat to occur in a gear case housing of the marine engine.

20. The method according to claim 17, further comprising causing the exchange of heat to occur along an exhaust tube that is configured to convey exhaust gases from the marine engine.

21. The method according to claim 20, further comprising causing the exchange of heat to occur along an exhaust tube cooling jacket on the exhaust tube, wherein the exhaust tube cooling jacket is configured to convey the cooling water from the marine engine towards the outlet.

22. The method according to claim 21, wherein the exhaust tube cooling jacket forms part of the heat exchanger.

* * * * *